United States Patent [19]

Branson

[11] Patent Number: 4,863,286

[45] Date of Patent: Sep. 5, 1989

[54] RECLOSEABLE BAG WITH PIVOTABLE FASTENER PROFILES

[75] Inventor: Mark E. Branson, Shelbyville, Ind.

[73] Assignee: KCL Corporation, Shelbyville, Ind.

[21] Appl. No.: 264,209

[22] Filed: Oct. 28, 1988

[51] Int. Cl.[4] ..... B65D 33/16

[52] U.S. Cl. ..... 383/63; 383/65; 24/587

[58] Field of Search ..... 383/63, 65; 24/576, 24/587, 579, 578

[56] References Cited

U.S. PATENT DOCUMENTS

| | | | |
|---|---|---|---|
| 2,780,261 | 2/1957 | Svec et al. | 383/65 |
| 3,172,443 | 3/1965 | Ausnit | 383/63 |
| 3,608,439 | 9/1971 | Ausnit | 383/63 |
| 3,679,511 | 7/1972 | Ausnit | 383/63 |
| 4,000,768 | 1/1977 | Siegel | 383/63 |
| 4,528,224 | 7/1985 | Ausnit | 383/63 |
| 4,619,021 | 10/1986 | Johnson | 383/63 |

*Primary Examiner*—Stephen Marcus
*Assistant Examiner*—Jes Pascua
*Attorney, Agent, or Firm*—Woodard, Emhardt, Naughton Moriarty & McNett

[57] ABSTRACT

A recloseable bag having a fastener assembly comprising two fastener profiles, each having a hinged double wall construction to prevent unintended opening of the bag due to internal forces exerted on the inside of the bag wall panels. The bag is easily openable when suh is intended by simple manipulation of pull flanges, thereby providing access to the interior of the bag. The hinged double wall construction also assures proper alignment of the fastener profiles across the length of the upper portion of the bag wall panels, making interlocking closure easy when pressure is applied on the outer walls of the bag behind the fastener profiles.

10 Claims, 6 Drawing Sheets

RECLOSEABLE BAG WITH PIVOTABLE FASTENER PROFILES

BACKGROUND OF THE INVENTION

This invention relates generally to recloseable bags of the type typically fabricated from plastic film and which comprises two opposing bag walls which are sealed together at the side edges and the bottom, and is particularly concerned with a new and improved recloseable, separable, flexible plastic fastener profile assembly for such bags which will efficiently resist opening due to forces which develop inside the bag, particularly when filled with product.

Recloseable bags have attained widespread use for containing various products, with convenient access thereto provided by recloseable fastener profile assemblies. However, a number of problems exist with respect to this type of closure mechanism.

When the fastener profile assemblies are manufactured separately and sealed onto the film during fabrication of the bag, there exists the problem of correct alignment of the seals with respect to the profile assemblies. The preferred embodiment is when the seal location is at the top of the profile assemblies toward the opening of the bag. This allows for easy opening from the top of the bag and discourages unintentional opening due to internal pressures on the bag walls. However, it is difficult to consistently seal the profile assemblies in the correct location. Consequently, it is desirable that a method and means be provided to effect such consistent sealing.

Another problem that has long been recognized in regard to flexible fastener profile assemblies is the unintentional opening of bags caused by internal pressures on the bag walls due to the load of contents or trapped air inside the bag. While many attempts have been made to alleviate this problem, none have been completely satisfactory. Representative are U.S. Pat. Nos. 3,338,284, 3,372,442 and 3,633,642. Manufacturing problems such as a more difficult extrusion process, a decreased production rate and associated therewith a higher production cost, are associated with the methods represented in the above enumerated patents.

Additional attempts have been made to alleviate this problem in U.S. Pat. Nos. 2,780,261 and 3,054,434. These patents illustrate a single hinge arrangement on one side of the flexible fastener profile assembly. This arrangement addresses the problem of the bag opening unintentionally from inside forces, however, this arrangement at the same time causes intentional opening of the bag to be more difficult. In particular, U.S. Pat. No. 3,054,434 illustrates a slide bar to assist in the interconnecting and unconnecting of the fastener profile assembly. This slide bar requires additional assembly and additional cost. Opening of the bags without such a slide bar is awkward and troublesome due to the unbalanced upper portion of the fastener profile assembly; there being a hinge arrangement on only one side of the fastener profile. U.S. Pat. No. 2,780,261 illustrates a sliderless fastener profile assemby, but is equally awkward and unbalanced.

SUMMARY OF THE INVENTION

Accordingly, it is the object of the present invention to provide a recloseable bag profile assembly which produces a strong seal when engaged, and which will successfully withstand internal pressures on the walls of the bag which might cause unintentional opening of the fastener profile assembly. It is a further object of the present invention to achieve such a desirable construction in an economical and efficient manner.

One embodiment of the present invention might include a recloseable bag having two opposing wall panels with inside surfaces facing toward each other, a bottom portion and openable top portion. Each wall panel has an upper portion which extends about the open top. A recloseable separable assembly is arranged proximate to the upper portions of each wall panel, the upper portions serving as pull flanges for separating the fastener assemblies. The fastener assemblies comprise first and second fastener profiles which have a double wall construction; an inner wall and an outer wall. The bottoms of the inner and outer walls are unconnected to each other, the top of said double walls being connected so as to create a hinge effect on both sets of the fastener profiles which allows the outer walls of the fastener profiles to move freely with the wall panels due to the load of contents of the bag or air trapped therein.

Other objects, features and advantages of the present invention will be readily apparent from the following description of a representative embodiment thereof, taken in conjunction with the accompanying drawings, although variations and modifications may be effected without departing from the spirit and scope of the novel concepts embodied in the disclosure.

DESCRIPTION OF THE PREFERRED EMBODIMENT

Figure 1:
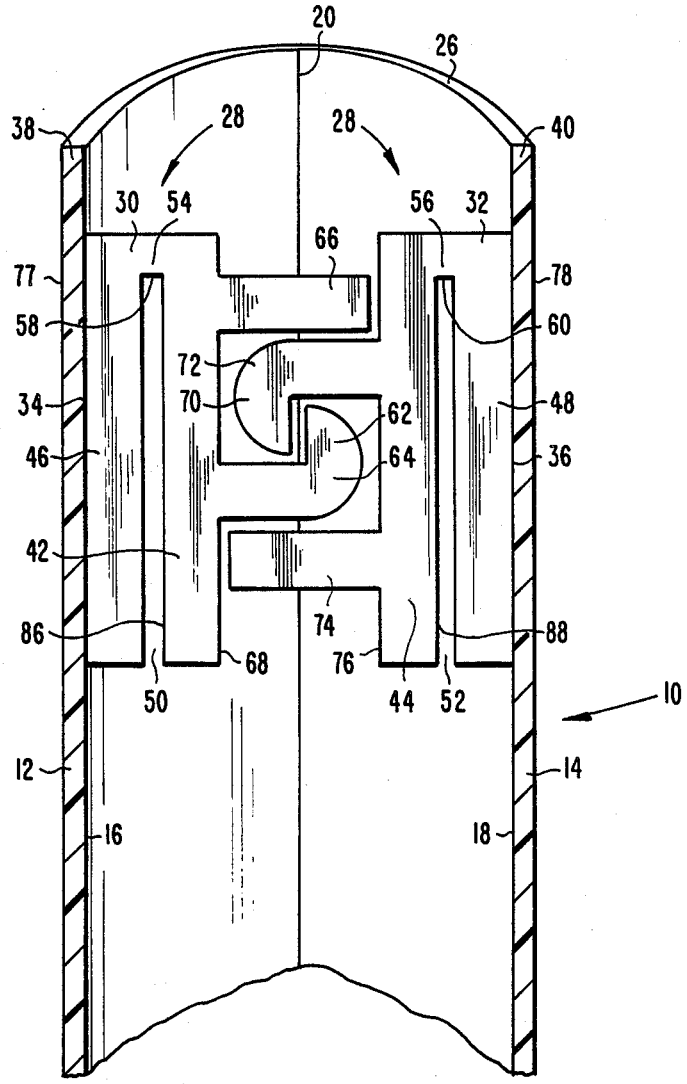
FIG. 1 is a fragmentary vertical sectional view showing the upper portion of a bag embodying the present invention.

For the purpose, of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 6:
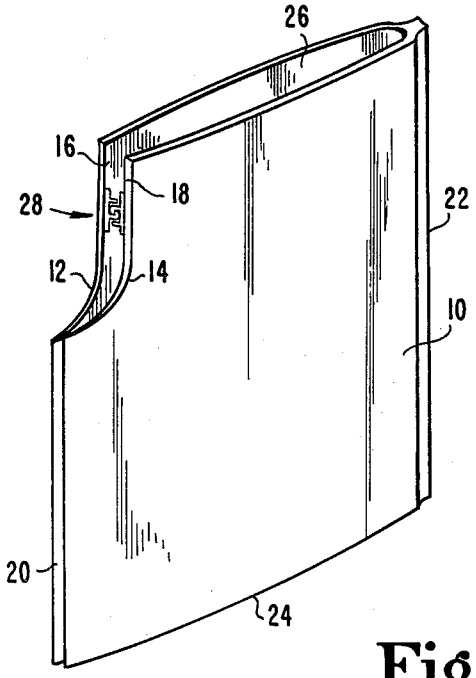
FIG. 6 is a fragmentary perspective view of a bag having a recloseable separable fastener assembly embodying the present invention.

As shown in FIG. 1, a bag 10, the upper portion of which is illustrated, is constructed of a suitable thin walled plastic film such as polyethylene, polypropylene or thermoplastic films. FIG. 6 shows the bag having opposing wall panels 12 and 14 with the inside surfaces 16 and 18 facing toward each other and has sealed side edges 20 and 22, a closed bottom edge 24, and an openable top portion 26. Returning to FIG. 1 a recloseable separable fastener assembly 28 is provided which comprises first and second cooperating flexible extruded plastic fastener profiles 30 and 32. The first and second profiles 30 and 32 are attached to the inside surfaces 16 and 18 of the wall panels 12 and 14. The attachment of the fastener profiles 30 and 32 to the inside surfaces 16 and 18 of the wall panels 12 and 14 is accomplished by fusing them to the wall panels at connection points 34 and 36. The connections 34 and 36 are made just below the top 26 of the wall panels 12 and 14 leaving enough wall panel above said connections to serve as pull flanges 38 and 40.

Both of the first and second profiles 30 and 32 are of a double wall construction, comprising inner walls 42 and 44 and outer walls 46 and 48, respectively, which are unconnected at their respective bottoms 50 and 52, but are connected at their respective tops 54 and 56. This arrangement provides hinges 58 and 60, respectively, between the inner wall 42 and outer wall 46 and between inner wall 44 and outer wall 48, respectively. This hinge effect allows the profiles 30 and 32 to move and stretch freely with the wall panels 12 and 14 without causing stress or pressure on the fastener assembly. In fact, any internal pressures exerted against the inside surfaces 16 and 18 of the wall panels 12 and 14 normally caused by load of contents or air trapped inside, will cause the outer walls 46 and 48, respectively, of the double wall construction of the fastener profiles 30 and 32 to move outwardly with the bag wall panels 12 and 14, and will bend the inner walls 42 and 44 downwardly, thereby creating even a greater and stronger seal.

As shown in FIGS. 1-5, the fastener profile 30 is comprised of a hook profile element 62 which has its head 64 facing upwardly, and a stabilizing flange element 66 located above the hook profile element 62. Both the hook profile 62 and stabilizing flange element 66 are formed on the outer side 68 of the inner wall 42 of the double wall construction. Similarly, the second profile 32 is comprised of a hook profile element 70 which has its head 72 facing downwardly, and a stabilizing flange element 74 located below the hook profile element 70. Both the hook profile 70 and stabilizing flange element 74 are formed on the outer side 76 of the inner wall 44 of the double wall construction.

Figure 2:
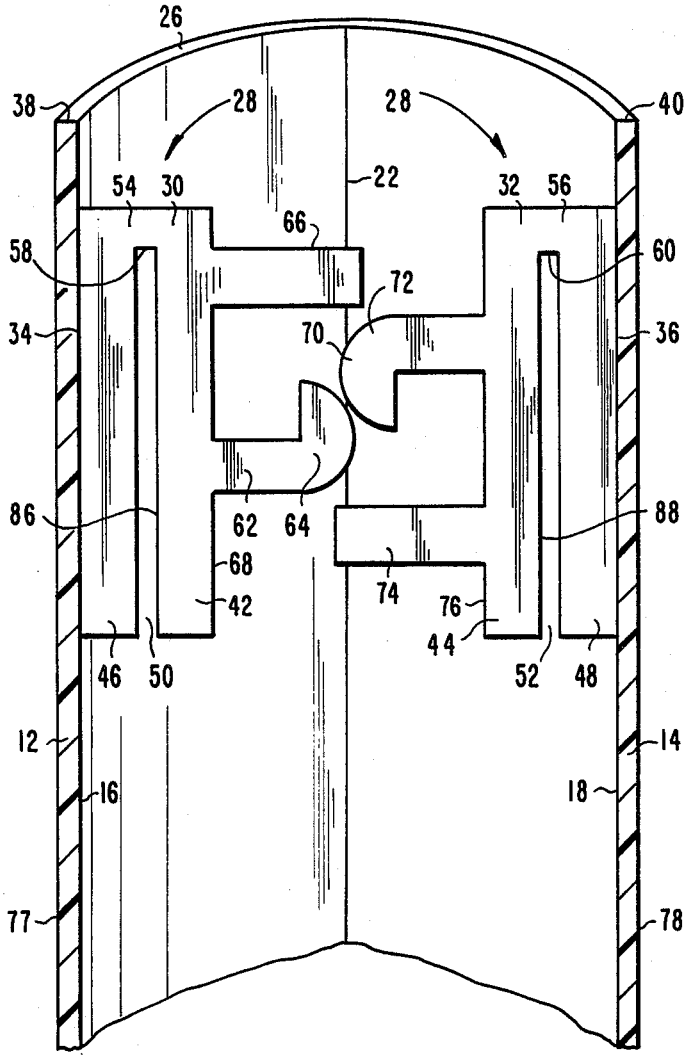
FIG. 2 is a fragmentary vertical sectional view showing cooperating alignment of the fastener profiles of FIG. 1 prior to interlocking.
Figure 3:
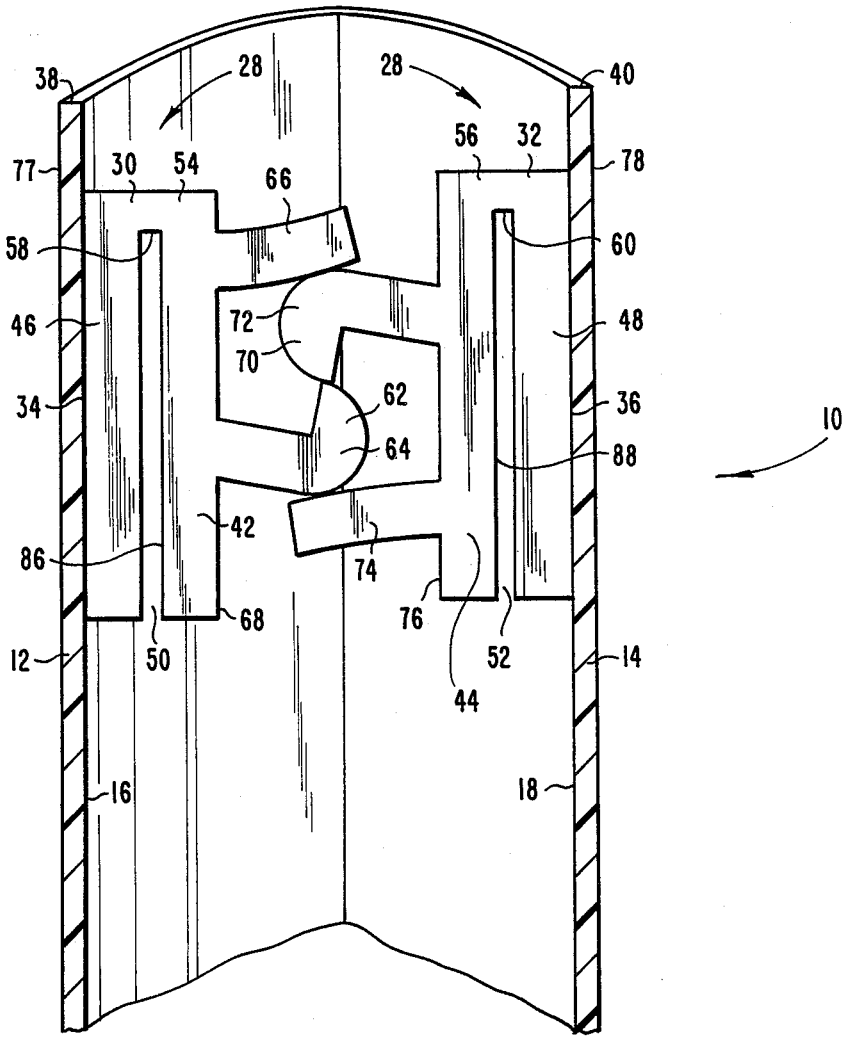
FIG. 3 is a fragmentary vertical sectional view showing the cooperating fastener profiles of FIG. 2 during interlocking.

The hook profile element 62 is located below and adjacent to the hook profile element 70 prior to interlocking as shown in FIG. 2. The stabilizing flange element 66 is located above and adjacent to hook profile 70 and stabilizing flange 74 is located below and adjacent to hook profile 62, also illustrated in FIG. 2. The hook profile element 62 and stabilizing flange element 66 are cooperatively aligned with and project toward hook profile element 70 and stabilizing flange element 74. The location and cooperative alignment thus described of the hook profile elements 62 and 70 and stabilizing flange elements 66 and 74 which extend lengthwise across the entire openable top portion 26 of the bag facilitates easy interlocking and closure. The heads 64 and 72 of the hook profile elements 62 and 70 are partially aligned in the same plane such that when pressure is applied to the outside surfaces 77 and 78 of the wall panels 12 and 14 during closure, as illustrated in FIG. 3, the rounded portions of the heads 64 and 72 cause the hook profile elements 62 and 70 to slide around each other until closure is completed, at which time the head portion of the hook profile elements 62 and 70 come to rest in an interlocked position, shown in FIG. 1. The stabilizing flange elements 66 and 74 help prevent misalignment of the hook profile elements by holding them in spaced relation to each other. Thus closure of the bag 10 is easily achieved.

Figure 4:
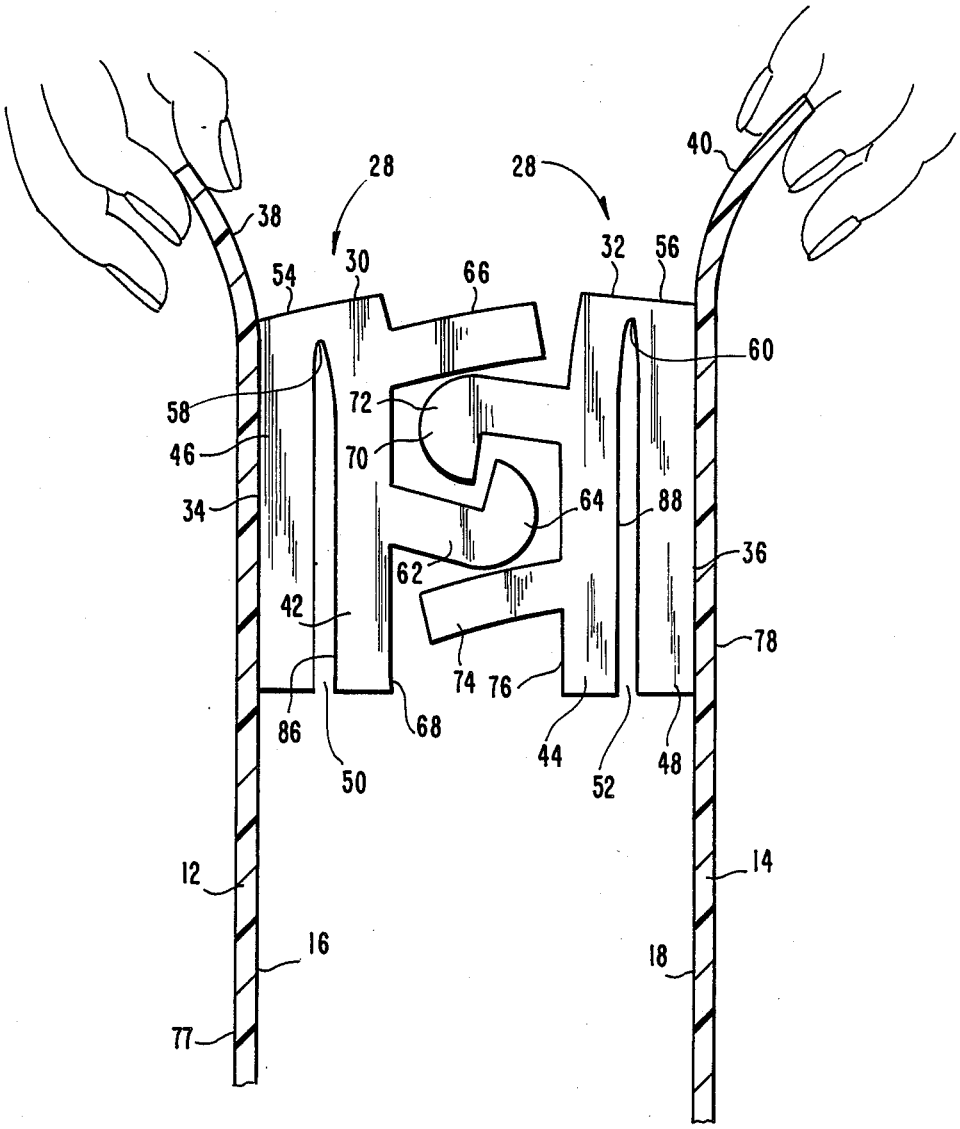
FIG. 4 is a fragmentary vertical sectional view showing disengagement of the fastener profiles.

Although the described fastener assembly 28 is constructed so that closure is easily achieved, and once achieved provides substantial resistance against separation even when subject to internal pressures within the bag as described above, this construction also allows for easy opening of the bag when desired. When the pull flanges 38 and 40 are pulled apart, as illustrated in FIG. 4, the interlocking fastener profiles 30 and 32 are initially separated, then by further pulling apart of the pull flanges 38 and 40 the separation will continue down the entire length of the bag 10, thereby allowing full access to the inside of the bag 10. The construction of the double walls of the fastener profiles 30 and 32 lends itself to the easy opening feature of the profile assembly.

In a preferred embodiment, the outer walls 46 and 48 of fastener profiles 30 and 32 have a thickness of between 2 and 20 mils depending on the type of material involved and the sealing conditions required. The thickness of the outer walls 46 and 48 can be controlled in order to optimize sealing of the fastener profiles 30 and 32 to the wall panels 12 and 14. Conversely, the thickness of inner walls 42 and 44 may be increased in order to provide th desired degree of stiffness for fastener profiles 30 and 32. Similarly, the thickness of hook profile elements 62 and 70 stabilizing flanges 66 and 74 may be very carefully controlled in order to provide the desired degree of stiffness. Preferred dimensions of the aforesaid hook profile are 0.08 inches in height, 0.02 inches in wall thickness, and 0.015 inches in length, and preferred dimensions of the aforesaid stabilizing flange are 0.05 inches in height and 0.02 inches in width. Similarly, the reduction in thickness of the fastener profiles 30 and 32, respectively, and hinges 58 and 60 can be controlled in order to provide the desired degree of stiffness while maintaining the flexibility required. In a preferred embodiment, the thickness of hinges 58 and 60 is 0.01 inches.

In an additional embodiment of the invention, not shown in the drawings, fastener profiles 30 and 32 may be integrally formed as part of wall panels 12 and 14. In this embodiment, outer walls 46 and 48 are integrally formed as part of wall panels 12 and 14. Hinges 58 and 60 then extend between outer walls 46 and 48 and inner walls 42 and 44 which extend downwardly into a bag 10. Again the presence of hinges 58 and 60 allows the inner walls 42 and 44 to flex thereby maintaining the interconnection between the first fastener profile 30 and second fastener profile 32 even when product within the bag presses against the seal.

Figure 5:
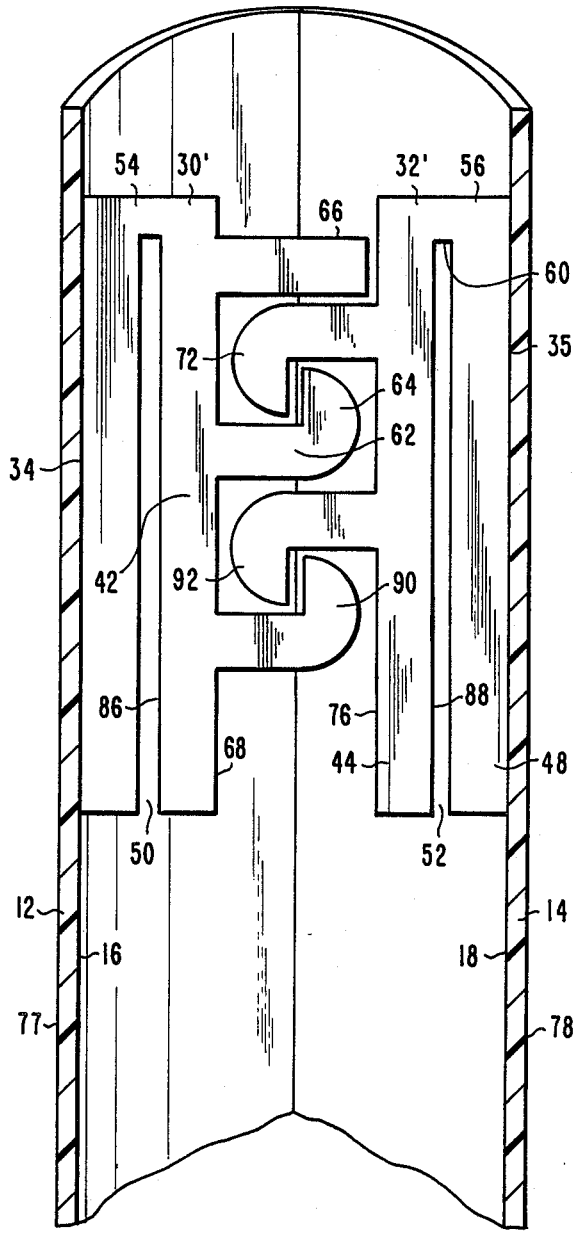
FIG. 5 is a fragmentary vertical sectional view of an additional embodiment of the invention.

FIG. 5 illustrates an alternate embodiment of the present invention which is substantially similar to that shown in FIG. 1, but additionally includes profile element 90 and 92 on each fastener profile 30'and 32'. Because of the additional hook profile elements 90 and 92, the stabilizing flange element 74 is unnecessary.

It will be thus apparent that the present invention provides an advantageous, especially convenient and efficient recloseable separable fastener arrangement which provides a unique combination of features which have not previously been available in this desirable combination. This fastener arrangement provides for assured alignment of the fastener profiles during sealing, a substantially strong seal even where internal pressure is exerted against the bag wall panels, and a seal which easily opens when desired by use of pull flanges.

This invention solves the problem of inconsistent sealing by having fastener profile assemblies which have a double wall construction; an inner and an outer wall. The inner and outer walls are unconnected at the bottom and connected at the top. This permits the profile to be sealed anywhere along the outer wall while retaining the desired functions of easy opening from the outside and unintentional opening from the bag walls.

It will be understood that variations and modifications may be effected without departing from the spirit and scope of the novel concepts of this invention.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A recloseable bag comprising two opposing plastic wall panels having sealed edges, and an openable top portion, a recloseable separable fastener assembly attached to the inside surface of said walls proximate to said top portion, said fastener assembly comprising:

oppositely disposed first and second cooperating fastener profiles arranged in a position facing each other; and said first and second cooperating fastener profiles having a double wall construction comprising an interlocking inner wall wall and an outer wall, the bottoms of said double walls being unconnected to each other and said double walls being connected to each other at the top thereof thereby creating a hinge means for allowing outer walls of said cooperating fastener profiles to move in conjunction with said wall panels without causing stress or pressure to said interlocking inner walls of said cooperating fastener profiles; and said first and second cooperating fastener profiles being selectively interlockable when pressed together and selectively releaseable when pulled apart.

2. The recloseable bag according to claim 1 wherein said cooperating fastener profiles are fused to said inside surface of said top portion of said wall panels.

3. The recloseable bag according to claim 1 wherein said cooperating fastener profiles interlock and tightly seal when pressure is applied to outside of said wall panels behind said cooperating fastener profiles.

4. The recloseable bag according to claim 1 wherein said double wall construction allows said outer walls to move, stretch and flex in conjunction with said wall panels while said interlocking inner walls remain engaged lessening stress or pressure on said cooperating fastener profiles.

5. The recloseable bag according to claim 1 wherein said first cooperating fastener profiles comprises one hook profile element and one stabilizing flange element and said second cooperating fastener profile comprises one hook profile element and one stabilizing flange element.

6. The recloseable bag according to claim 1 wherein said first and second cooperating fastener profile include a plurality of hooks.

7. The recloseable bag according to claim 1 wherein the outside surfaces of said outer walls of said double walls of said cooperating fastener profiles are fused to said inside surface of said wall panels proximate to said top portion.

8. The recloseable bag according to claim 1 wherein said cooperating fastener profiles are integrally formed as part of said inside surface of said wall panels proximate to said top portion.

9. A recloseable bag comprising two opposing wall panels having inside surfaces facing toward each other and having sealed side edges, and an openable top portion, and a recloseable separable fastener assembly attached to the inside surface of said walls proximate to said top portion, said fastener assemby comprising:

a combination of a first flexible plastic separate fastener profile element on one of said inside surfaces of said wall panels and projecting toward the other of said inside surfaces of said wall panels, and a cooperating second flexible plastic separate fastener profile element on said other inside surface of said wall panel projecting toward said first fastener profile element, each fastener profile element being aligned with respect to the other for closure, and extending the length of said openable top portion;

said fastener profile elements being arranged for alignment thereby facilitating interlocking closure engagement of the fastener assembly by applying pressure from the outside of said wall panels behind said fastener profile elements;

said first fastener profile element having a double wall construction comprising an inner wall and an outer wall, said double wall being connected only at the top thereby allowing said outer wall to move freely with the movement of said bag walls lessening stress or pressure on said fastener profile elements while interconnected;

said second fastener profile element having a double wall construction comprising an inner wall and an outer wall, said double wall being connected only at the top thereby allowing said outer wall to move freely with the movement of said bag walls lessening stress or pressure on said fastener profile elements while interconnected; and said fastener profile elements being mutually interlocking and adapted for easy opening separation from said interlocking engagement by use of pull flanges located above said fastener profile elements, so that, when said pull flanges are pulled apart, the interlocking elements will be separated initially and then by further pulling said separation will continue down the entire length of said fastener profile elements, thereby allowing full access through the top of said bag.

10. A fastener assembly adapted for use with a recloseable bag having opposite wall panels with inside surfaces facing toward each other and having sealed side edges, and an openable top portion, said fastener assembly being adapted for attachment to said inside surfaces at the top portion of said wall panels, said fastener assembly comprising:

first and second fastener profiles each having a double wall construction comprising an inner wall and an outer wall, the bottoms of said inner and outer walls being unconnected to each other and said double walls being connected to each other only at the top thereby allowing said outer walls to move freely with the movement of said wall panels lessening stress or pressure on said fastener profiles while interconnected.

* * * * *